US005282324A

United States Patent [19]

Cheng

[11] Patent Number: 5,282,324

[45] Date of Patent: Feb. 1, 1994

[54] VALVELESS VENTILATING ARRANGEMENT FOR A SHOE AND METHOD

[76] Inventor: Peter S. C. Cheng, 5 Ross St., Toronto, Ontario, Canada M5T 1Z8

[21] Appl. No.: 37,739

[22] Filed: Jun. 3, 1993

Related U.S. Application Data

[63] Continuation of Ser. No. 905,687, Jun. 29, 1992, abandoned.

[51] Int. Cl.[5] ..... A43B 7/06

[52] U.S. Cl. ..... 36/3 B; 36/3 R

[58] Field of Search ..... 36/3 R, 3 B, 43, 44, 36/3 A, 29, 35 B

[56] References Cited

U.S. PATENT DOCUMENTS

| | | | |
|---|---|---|---|
| 733,167 | 7/1903 | Denton | 36/3 B |
| 1,065,671 | 6/1913 | Eick | 36/3 R |
| 1,176,445 | 3/1916 | Haran | 36/3 R |
| 1,260,942 | 3/1918 | Price et al. | 36/3 R |
| 1,369,590 | 2/1921 | Voltolini | 36/3 R |
| 1,453,394 | 5/1923 | Klepac | 36/3 B |
| 1,666,698 | 2/1928 | Williams, Sr. | 36/3 R |
| 1,809,323 | 6/1931 | Williams, Sr. | 36/3 R |
| 2,086,790 | 7/1937 | Wroten | 36/3 R |
| 2,545,062 | 3/1951 | Whittington | 36/3 B |
| 3,475,836 | 11/1969 | Brahm | 36/3 B |
| 4,760,651 | 8/1988 | Pon-Tzu | 36/3 B |
| 4,860,463 | 8/1989 | Pin | 36/3 R |
| 4,974,342 | 12/1990 | Nakamura | 36/3 B |

FOREIGN PATENT DOCUMENTS

| | | | |
|---|---|---|---|
| 0911767 | 11/1962 | United Kingdom | 36/3 B |
| 2189679 | 11/1987 | United Kingdom | 36/3 B |

*Primary Examiner*—Paul T. Sewell
*Assistant Examiner*—Thomas P. Hilliard
*Attorney, Agent, or Firm*—Kirschstein et al.

[57] ABSTRACT

A shoe is efficiently ventilated by forcing a low volume of primary air through a plurality of throttle orifices at high velocity downstream of a passage formed in a sole. A low pressure area is created within the passage. A high volume of stale secondary air from the shoe interior is accelerated into the low pressure area. The secondary air is entrained by the primary air and together form a combined jet-like air stream that is forcefully ejected from the shoe.

14 Claims, 2 Drawing Sheets

10
12
14
16
18
20
24
28
30
40
42
44
2
3
5
6

10
12
14
16
18
20
22
24
26
28
30
32
4

VALVELESS VENTILATING ARRANGEMENT FOR A SHOE AND METHOD

This is a continuation of application Ser. No. 07/905,687, filed Jun. 6, 1992, now abandoned.

BACKGROUND OF THE INVENTION

1. Field of the Invention

This invention generally relates to shoe ventilation and, more particularly, to accelerating a large volume of low velocity stale air within a shoe by using a smaller volume of high velocity air.

2. Description of Related Art

Stale air collected within a shoe, particularly at the enclosed toe region, is generally discharged from a ventilated shoe by a pumping action generated by an on-board pump during walking. For example, see U.S. Pat. Nos. 2,441,879; 2,668,372; 4,654,982; 4,760,651 and 4,974,342.

Experience has shown, however, that the known ventilated shoes, nevertheless, allow odor and perspiration to build up. The known ventilated shoes employ a foot-operated pump on the shoe in which a predetermined volume of stale air enters the pump and a lesser volume or, at best, the same volume of stale air is discharged by the pump. The volume of stale air that enters the pump is usually a very small amount and, as a result, one must repeatedly activate the pump by walking or running a great deal in order to adequately ventilate the shoe. There are times when such excessive activity is not desired or possible.

SUMMARY OF THE INVENTION

1. Objects of the Invention

It is a general object of this invention to advance the state of the art of ventilated shoes.

It is another object of this invention to effectively and adequately ventilate a shoe without requiring excessive walking or running activity.

Another object of this invention is to use a small volume of high velocity air to accelerate a much larger volume of low velocity stale air.

A further object of this invention is to keep one's foot drier and help prevent athlete's foot.

Still another object of this invention is to remove odor from shoes.

2. Features of the Invention

In keeping with these objects, and others which will become apparent hereinafter, one feature of this invention resides, briefly stated, in a ventilating arrangement for a shoe, which comprises a sole having a toe portion formed with an air inlet in open communication with the interior of the shoe, a heel portion formed with an air outlet in open communication with the exterior of the shoe, and a passage extending along a flow path from the inlet to the outlet. The sole may be an insole removably mounted within the shoe, or may be integrally incorporated therewith.

In accordance with this invention, at least one throttle orifice is, and preferably a plurality of throttle orifices are, formed in the sole, each orifice being in open communication with, and facing downstream of, the passage. The orifices are preferably located at the heel portion, and extend through walls which are in mutual parallelism. The orifices are successively arranged along the passage which advantageously extends along the perimeter of the sole at one side thereof.

In further accordance with this invention, foot-operated pumping means are provided on the sole, and are operative for forcing a low volume of primary air through each orifice at high velocity downstream of the passage. This creates within the passage a low pressure area into which is accelerated a high volume of secondary air entering the inlet from the shoe interior. The secondary air is entrained by the faster moving primary air, and together they form a combined air stream that is forcefully ejected from the outlet. The positions of the air inlet and outlet could be reversed.

By forcing the primary air through each orifice and entraining the secondary air with the primary air, the volume of air discharged from the shoe is much greater than in the prior art ventilated shoes where, at best, the ratio of the volume of stale air entering and exiting the pump was about 1:1. In accordance with this invention, this ratio is increased at least tenfold. It is no longer necessary to require repeated activation of a pump by excessive physical activity to ventilate a shoe.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
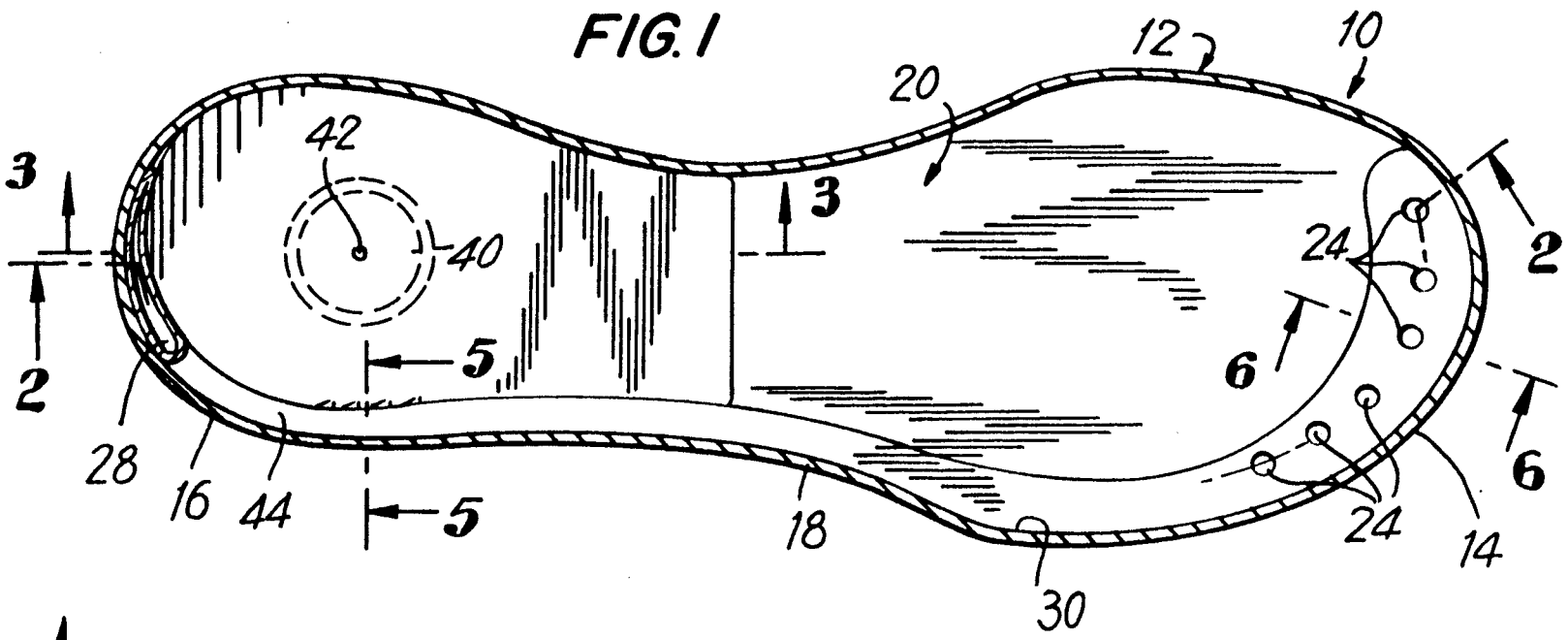
FIG. 1 is a top plan view of a ventilating arrangement for a shoe in accordance with this invention.
Figure 2:
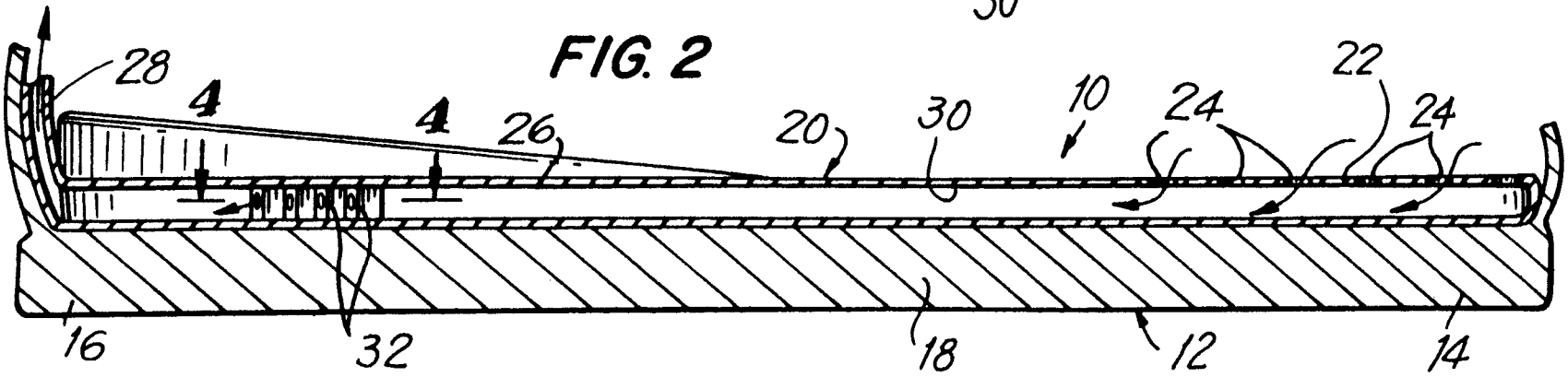
FIG. 2 is a sectional view taken on line 2—2 of FIG. 1.

Referring now to the drawings, reference numeral 10 in FIGS. 1 and 2 generally identifies a ventilating arrangement for a shoe 12 shown in broken-away, sectional view. Shoe 12 has a toe region 14, a heel region 16 and an intermediate region 18 extending between the toe and heel regions. The illustrated ventilating arrangement includes a sole 20 formed as an insole removably mounted within the shoe. It will be expressly understood, however, that the ventilating arrangement 10 could equally well be integrally incorporated into the shoe itself and, hence, not be removably mounted therefrom.

Figure 6:
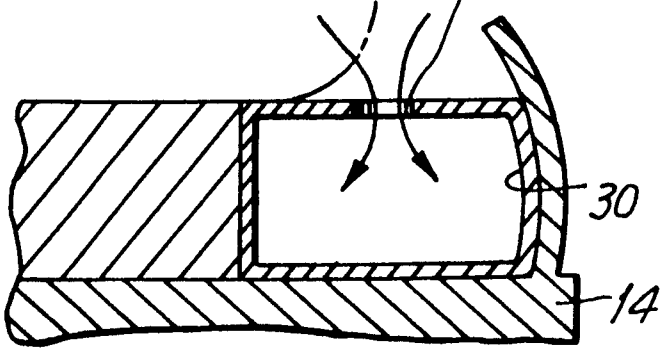
FIG. 6 is a greatly enlarged, sectional view taken on line 6—6 of FIG. 1.

Sole 20 includes a toe portion 22 formed with a series of holes 24 (see FIG. 6) serving as an air inlet in open communication with the interior of the shoe above the toe region 14. Sole 20 further includes a heel portion 26 formed with an air outlet 28 in open communication with the exterior of the shoe. Sole 20 still further includes a passage 30 extending along a flow path along one peripheral side of the sole from the air inlet holes 24 to the air outlet 28 lengthwise of the sole.

At least one throttle orifice 32 is, and advantageously four throttle orifices 32 are, formed in the sole at the heel portion 26 in open communication with the passage 30. Each orifice 32 faces (see FIG. 4) downstream of the passage 30. Orifices 32 extend through individual walls 34 arranged in a zig-zag shape. Walls 34 are in mutual parallelism, and are located at the heel portion 16. The orifices 32 are successively arranged one after another along the passage 30.

Figure 3:
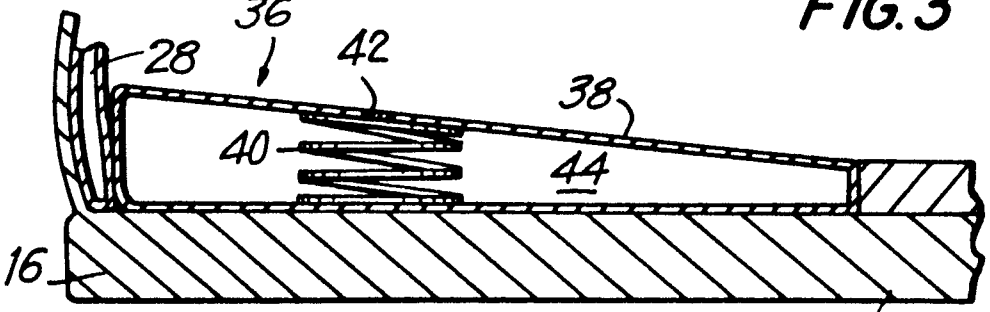
FIG. 3 is an enlarged, sectional view taken on line 3—3 of FIG. 1.

A foot-operated pump 36 (see FIG. 3) is located at the heel portion 26. Pump 36 includes a heel strike 38 overlying and inclined relative to the sole, and a return coil spring 40 between the heel strike 38 and the sole, and a pump inlet 42 for allowing air within the shoe to enter an interior pump chamber 44. During walking, the weight of a person's heel exerted on the heel strike 38 compresses the spring 40, and the lifting of the person's foot allows the spring to return to its original position, thereby pulling air from the interior of the shoe through the pump inlet 42 into the pump chamber 44.

Figure 4:
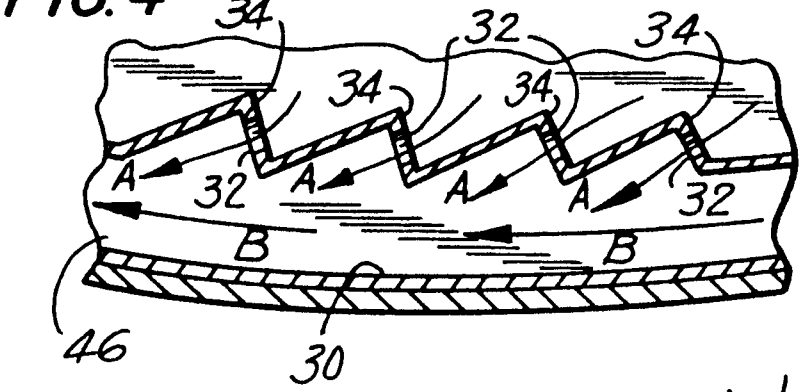
FIG. 4 is a greatly enlarged, sectional view taken on line 4—4 of FIG. 2.
Figure 5:
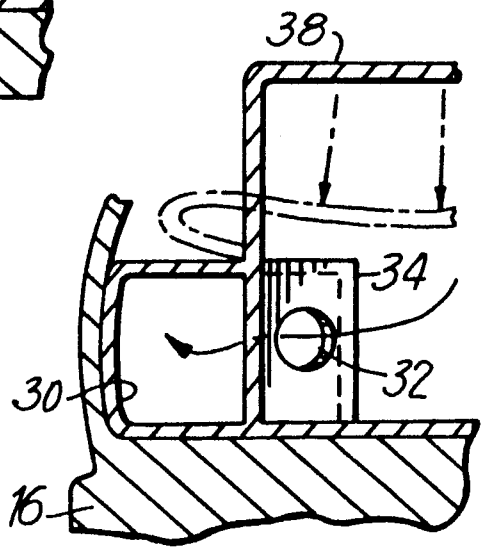
FIG. 5 is a greatly enlarged, sectional view taken on line 5—5 of FIG. 1.

When the spring 40 is compressed, with the person's heel overlying and blocking the pump inlet 42, a small volume of air within the pump chamber 44, hereinafter known as primary air, is forced through the orifices 32 at high velocity in the direction of arrows A in FIG. 4 downstream of the passage 30. This creates within the passage 30 a low pressure mixing chamber or area 46 into which is accelerated in the direction of arrows B a high volume of stale air, hereinafter also known as secondary air. The secondary air enters the passage 30 via the air inlet holes 24 from the shoe interior. The secondary air is entrained by the faster moving primary air, and together they form a combined air stream that is forcefully ejected from outlet 28.

In contrast to the prior art, where the ratio of the volume of stale air entering a pump to the volume of air exhausted by the pump is, at best, 1:1, the volume of the secondary air discharged by the ventilating arrangement of this invention is about 10 to 20 times greater than the volume of the primary air due to the Venturi effect created downstream of the orifices 32. The low pressure area 46 induces the high volume flow of the stale secondary air into the high velocity primary air, thereby creating a jet-like exhaust flow. The high velocity primary air imparts its energy to the secondary air in the low pressure area 46 which acts as a reaction or intermixing zone.

It will be understood that each of the elements described above, or two or more together, also may find a useful application in other types of constructions differing from the types described above.

While the invention has been illustrated and described as embodied in a ventilating arrangement for a shoe and method, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A ventilating arrangement for a shoe, comprising:

(a) a sole having an air inlet in constantly open communication with the interior of the shoe, an air outlet in constantly open communication with the exterior of the shoe, and a constantly open passage extending along a flow path from the inlet to the outlet, said passage having a constantly open mixing chamber between the inlet and the outlet, and a predetermined flow-through cross-section;

(b) at least one throttle orifice formed in the sole and being in constantly open communication with the mixing chamber, and facing downstream of the passage into the mixing chamber, said one throttle orifice having a flow-through cross-section smaller than said predetermined cross-section of the passage; and (c) foot-operated pumping means on the sole for forcing a low volume of primary air through said one throttle orifice into the mixing chamber at high velocity downstream of the passage to create within the mixing chamber a low pressure zone into which is accelerated a high volume of secondary air entering the inlet from the shoe interior, said secondary air being forcefully drawn by, and mixed with, the primary air in the mixing chamber to form an air stream mixture that is forcefully conveyed away from the mixing chamber and expelled from the outlet, said high volume of secondary air being many times greater than said low volume of primary air due to the primary air imparting its high velocity energy to the secondary air which induces the secondary air to flow into the mixing chamber.

2. The arrangement according to claim 1, wherein the sole is an insole removably mounted within the shoe.

3. The arrangement according to claim 1, wherein the air inlet comprises a plurality of inlet holes extending into the passage.

4. The arrangement according to claim 1, wherein the passage extends along the perimeter of the sole at one side of the sole.

5. The arrangement according to claim 1, wherein additional throttle orifices are formed in the sole and are in open communication with, and face downstream of, the passage.

6. The arrangement according to claim 5, wherein the orifices are located at the heel portion.

7. The arrangement according to claim 5, wherein the orifices extend through walls which are in mutual parallelism.

8. The arrangement according to claim 1, wherein the sole has a toe portion formed with said inlet, and a heel portion formed with said outlet.

9. The arrangement according to claim 5, wherein the orifices are successively arranged along the passage.

10. The arrangement according to claim 1, wherein the pumping means includes a heel strike portion overlying and inclined relative to the sole, and a return spring between the strike portion and the sole.

11. A method of ventilating a shoe, comprising the steps of:

(a) forming a sole with an air inlet in constantly open communication with the interior of the shoe;

(b) forming the sole with an air inlet in constantly open communication with the exterior of the shoe;

(c) forming in the sole a constantly open passage which extends along a flow path from the inlet to the outlet, said passage having a mixing chamber between the inlet and the outlet, and a predetermined flow-through cross-section;

(d) forming in the sole at least one throttle orifice in constantly open communication with the mixing chamber, and facing downstream of the passage into the mixing chamber, said one throttle orifice having a flow-through cross-section smaller than said predetermined cross-section of the passage; and (e) forcing a low volume of primary air through said one throttle orifice into the mixing chamber at high velocity downstream of the passage to create within the mixing chamber a low pressure zone into which is accelerated a high volume of secondary air entering the inlet from the shoe interior, said secondary air being forcefully drawn by, and mixed with, the primary air in the mixing chamber to form an air stream mixture that is forcefully conveyed away from the mixing chamber and expelled from the outlet, said high volume of secondary air being many times greater than said low volume of primary air due to the primary air imparting its high velocity energy to the secondary air which induces the secondary air to flow into the mixing chamber.

12. The method according to claim 11; and further comprising removably mounting the sole within the shoe.

13. The method according to claim 11, wherein the step of forming said at least one throttle orifice includes forming additional throttle orifices in the sole, and the step of successively arranging the orifices along the passage.

14. The method according to claim 11, wherein the step of forming said inlet is performed at a toe portion of the sole, and wherein the step of forming said outlet is performed at a heel portion of the sole.

* * * * *